US008019108B2

(12) United States Patent
Hayashi

(10) Patent No.: US 8,019,108 B2
(45) Date of Patent: Sep. 13, 2011

(54) SPEAKER SYSTEM

(75) Inventor: Toyofumi Hayashi, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 1366 days.

(21) Appl. No.: 11/544,247

(22) Filed: Oct. 6, 2006

(65) Prior Publication Data

US 2007/0081687 A1 Apr. 12, 2007

(30) Foreign Application Priority Data

Oct. 7, 2005 (JP) ..... 2005-294481

(51) Int. Cl.
*H04R 25/00* (2006.01)

(52) U.S. Cl. ..... 381/349; 381/353; 181/156

(58) Field of Classification Search ..... 381/345–347, 381/349, 353, 354, 160; 181/155–156, 199
See application file for complete search history.

(56) References Cited

U.S. PATENT DOCUMENTS

| | | | | |
|---|---|---|---|---|
| 3,547,221 | A | 12/1970 | Hedberg | |
| 6,396,936 | B1 | 5/2002 | Nevill | |
| 7,481,295 | B2 * | 1/2009 | Noro et al. | 381/349 |

FOREIGN PATENT DOCUMENTS

| | | | |
|---|---|---|---|
| JP | 2-12788 | | 1/1990 |
| JP | 2-12788 | U | 1/1990 |
| JP | 2-12788-UM | A | 4/1990 |
| JP | 4-409096 | | 10/1992 |
| JP | 2005-193071 | * | 6/2005 |
| WO | WO-00/32010 | | 6/2000 |

* cited by examiner

*Primary Examiner* — Suhan Ni
(74) *Attorney, Agent, or Firm* — Morrison & Foerster LLP

(57) ABSTRACT

A loudspeaker system includes a speaker enclosure that includes a plurality of faces which surround so as to have an internal space tightly closed, a cut-away portion that is cut away along a contour of a virtual plane figure surrounded by a line on one face of the speaker enclosure while a part of the contour as a connection portion is left, a sealing member that covers the cut-away portion so as to tightly seal the internal space of the speaker enclosure, and a loudspeaker that is provided on any face of the speaker enclosure. A portion of the face surrounded by the cut-away portion is a diaphragm capable of vibrating due to bending elasticity while a near portion of the connection portion serves as a point of support. The sealing member is attached to the diaphragm and a peripheral portion which includes a portion of the one face surrounding the diaphragm so as to tightly seal the internal space of the speaker enclosure in a state that the diaphragm can vibrate.

8 Claims, 14 Drawing Sheets

SPEAKER SYSTEM

BACKGROUND OF THE INVENTION

The present invention relates to the technology of a loudspeaker system.

Various types of loudspeaker system have been developed, as represented by the use of a bass-reflex or a drone cone, for example.

The bass-reflex reinforces the bass, using a Helmholtz resonance, and the drone cone mounts a loudspeaker unit having no drive circuit, and reinforces the bass, using a resonance with the air within the volume of an enclosure.

In the bass-reflex, in the case where the volume of the enclosure is small, it is required to make a resonant tube smaller and longer to lower the resonant frequency, so that the air resistance is increased to remarkably degrade a bass augmentation function, and the speed of air passing through the resonant tube is very fast, leading to a problem that the wind noise of a flute occurs.

Also, in the drone cone, it is required to increase its mass to lower the resonant frequency. And to lower the resonant frequency, it is required to increase the compliance of the edge supporting the diaphragm, but to support the diaphragm of large mass, it is required to increase the spring property or strength of the edge, which is reciprocal to the compliance. Also, it is difficult that the heavy diaphragm is vibrated completely parallel, often attended with an abnormal vibration called a rolling or rocking. This abnormal vibration increases distortion and decreases the efficiency by consuming energy uselessly.

To compensate for a shortcoming of the drone cone, a method was offered in patent document 1, for example. With this method, the rolling or rocking can be prevented, but due to a structure that the weight of the diaphragm (flap) is borne by the edge provided peripherally, the edge is required to have strength, leading to a problem that Q of the vibration is smaller because of its damping effect.

[Patent document 1] WO00/32010

SUMMARY OF THE INVENTION

To solve the above-mentioned problems, it is an object of the invention to provide a loudspeaker system and a loudspeaker enclosure in which the loudspeaker can output sufficient bass components irrespective of its small size, the rolling or rocking is prevented, and Q of the vibration of the diaphragm can be increased.

The present invention provides a loudspeaker system, comprising:

a loudspeaker enclosure that includes a plurality of faces which surround so as to have an internal space tightly closed, at least one of the plurality of faces having a cut-away portion that is cut away along a contour of a virtual plane figure surrounded by a line on one face of the speaker enclosure while a part of the contour as a connection portion is left;

a sealing member that covers the cut-away portion so as to tightly seal the internal space of the speaker enclosure; and a loudspeaker that is provided on any face of the speaker enclosure, wherein a portion of the face surrounded by the cut-away portion is a diaphragm capable of vibrating due to bending elasticity while a near portion of the connection portion serves as a point of support; and wherein the sealing member is attached to the diaphragm and a peripheral portion which includes a portion of the one face surrounding the diaphragm so as to tightly seal the internal space of the speaker enclosure in a state that the diaphragm can vibrate.

In a preferred embodiment of the invention, the sealing member is a sheet-like member provided along the contour direction. A sectional shape of the sealing member is linear and a length of the line of the sectional shape is longer than a width of a cross-section of the cut-away portion, a direction of the width of the cross-section being perpendicular to an extending direction of the contour of the virtual plane figure.

Also, in another preferred embodiment of the invention, the sealing member is attached from the diaphragm over the peripheral portion on a surface side or an internal space side of the one face.

Also, in another preferred embodiment of the invention, the sealing member is attached from the diaphragm over the peripheral portion so as to cross the cut-away portion from a surface side of the one face to an internal space side of the one face.

Also, in a further preferred embodiment of the invention, the sealing member has a linear sectional shape. The length of the line is varied in accordance with a distance from the connection portion.

In a further preferred embodiment of the invention, the sealing member has a curved portion in a sectional shape of the sealing member. A thickness of the curved portion is smaller than the other sectional portion of the sealing member.

Also, in a further preferred embodiment of the invention, the sealing member is integrally formed with at least the one face.

Also, in a further preferred embodiment of the invention, both end parts of the sealing member in a sectional direction are fixed to the diaphragm and the peripheral portion. An end part fixed to the diaphragm is proximate to an edge of the diaphragm.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

The preferred embodiments of the present invention will be described below with reference to the accompanying drawings.

Figure 1:
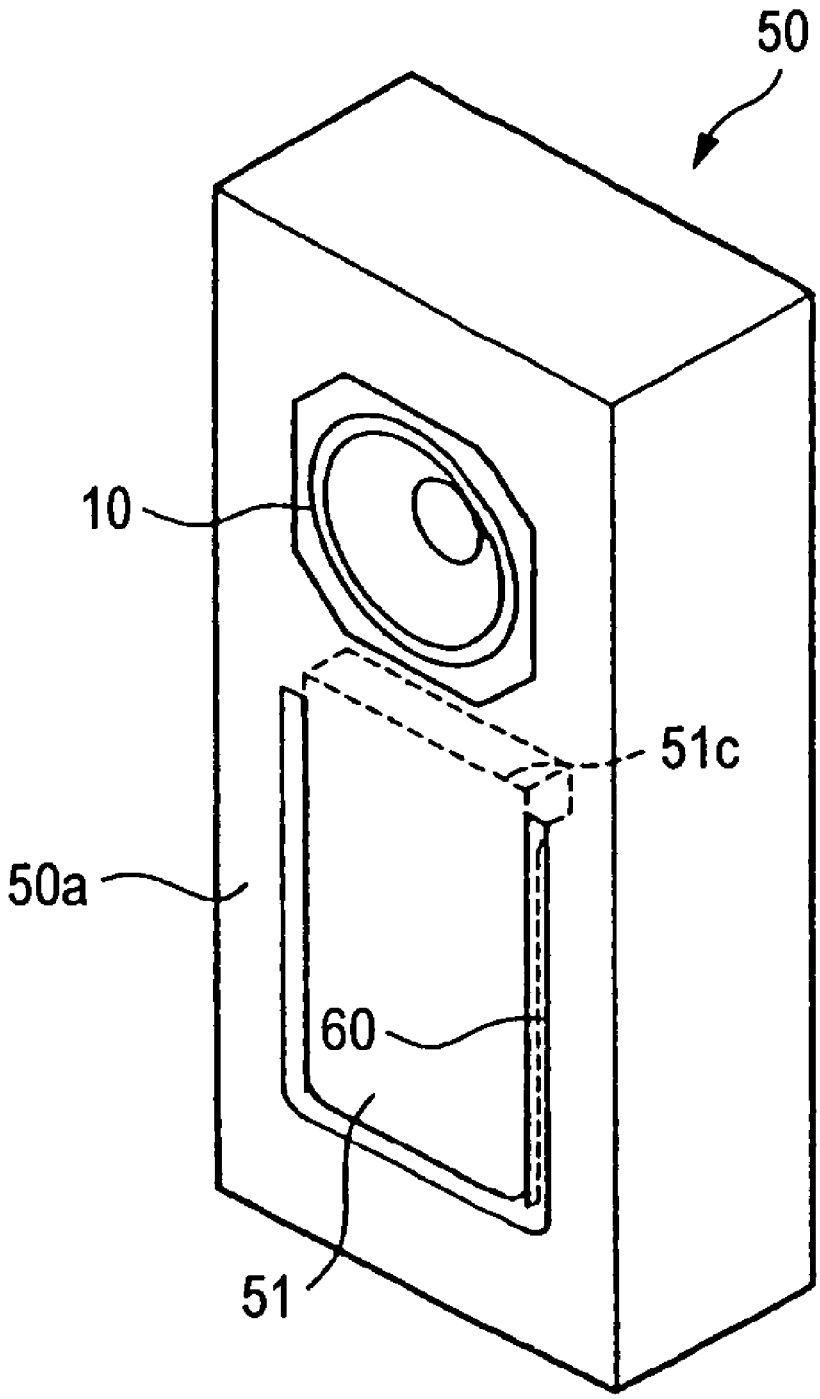
FIG. 1 is a perspective view showing the appearance of a loudspeaker system according to an embodiment of the present invention.

FIG. 1 is a perspective view showing the appearance of a loudspeaker system according to an embodiment of the invention. In FIG. 1, reference numeral 10 denotes a loudspeaker diaphragm having a voice coil and a magnet, and is mounted on the front face of a speaker enclosure 50. The speaker enclosure 50 is a closed type enclosure like a rectangular parallelepiped, and formed of plate members (e.g., wood, synthetic resin, metal, or laminate thereof) on six faces.

As shown in FIG. 1, a loudspeaker mounting hole is provided through a baffle plate 50*a* on the front face of the speaker enclosure 50, and the loudspeaker 10 is inserted through this loudspeaker mounting hole. In this case, a frame on the front face of the loudspeaker 10 is fixed to the baffle plate 50*a* by screws.

A cut-away portion 60 cut away like a U-character in the long slender shape is provided from the central part of the baffle plate 50*a* to the bottom part. The cut-away portion 60 like the U-character is encompassed within the following concept in this invention. That is, the cut-away portion is cut away along the contour of a virtual plane figure surrounded by the line on one face of the speaker enclosure to have a part of the contour as a connection portion and to leave the connection portion behind. If this concept is applied to the U-character shape, supposing that the virtual plane figure has partially the shape of U-character, the cut-away portion 60 of U-character shape is made by cutting away along the contour of the virtual plane figure to have the other portion than the U-character shape (the upper portion of U-character shape in FIG. 1) as the connection portion, and to leave this connection portion behind. In this embodiment, the upper portion of U-character shape is the connection portion 51*c* as indicated by the broken line in FIG. 1.

A portion surrounded by the cut-away portion 60 is a diaphragm 51 capable of vibrating due to bending elasticity near the connection portion 51*c* (support member). That is, the connection portion 51*c* at an upper part of the diaphragm 51 is integral with the baffle plate 50*a*, and the other portion is separated from the baffle plate 50*a* by the cut-away portion 60 of U-character shape, whereby the diaphragm 51 can freely vibrate in a state where its upper end is fixed. In the following, a lower portion of the diaphragm 51 is called a vibration portion 51*a*. Also, the diaphragm 51 has its thickness formed thinner than the other portion of the baffle plate 50*a*, as shown in FIG. 2A.

The diaphragm 51 (i.e., baffle plate 50*a*) is formed from a member having both the acoustically sufficient strength and bending elasticity. Herein, the "acoustically sufficient strength" means not permitting the passage of air, having a sufficiently greater density than the air, and having the enough strength and bending elasticity to produce the sound wave due to vibration. Also, the diaphragm 51 has a property capable of shutting off the sound wave to some extent by itself.

Also, the degree of "bending elasticity" is the extent that the diaphragm 51 can be kept almost horizontal by bearing its dead weight, when placed horizontally. To satisfy this characteristic, the diaphragm 51 (i.e., baffle plate 50*a*) is made from a thin wood plate, a thin synthetic resin, a metal plate or a laminate thereof.

Figure 2A:
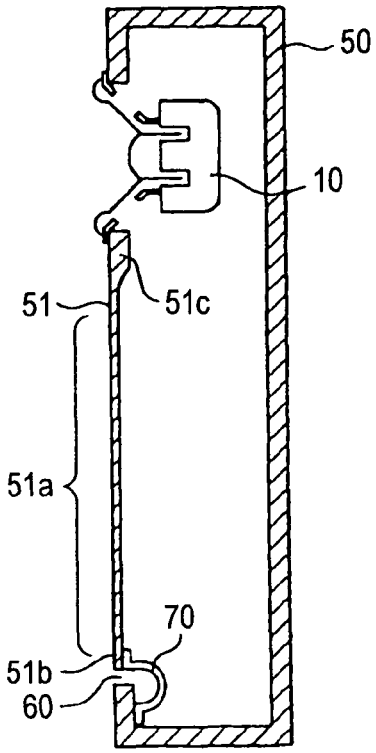
FIGS. 2A to 2C are views showing an internal structure of the loudspeaker system according to the embodiment.
Figure 2B:
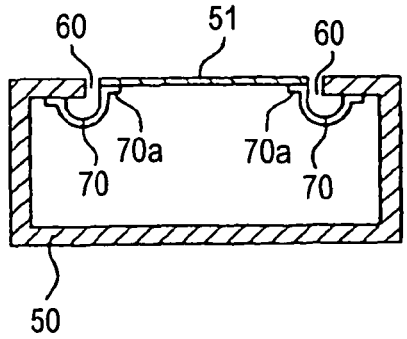
Figure 3:
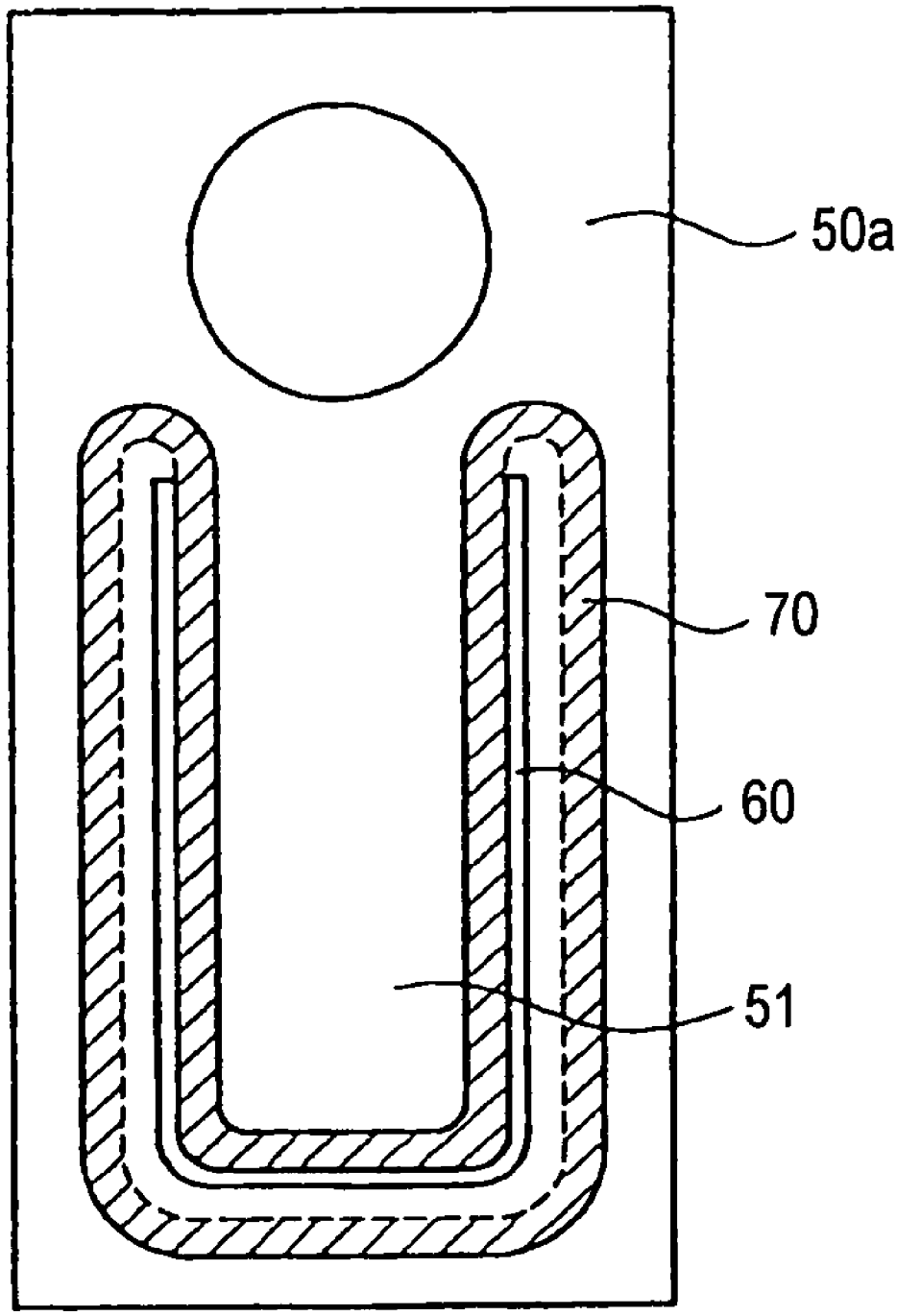
FIG. 3 is a view showing the rear face of a baffle plate 50*a* according to the embodiment.

FIGS. 2A and 2B are a side cross-sectional view and a lateral cross-sectional view of this embodiment. As shown in FIGS. 2A and 2B, the cut-away portion 60 is covered from the inside of the speaker enclosure 50 by an edge 70 of arch shape in section to keep the speaker enclosure 50 airtight. FIG. 3 is a view showing the rear face of the baffle plate 50*a*. The edge 70 covers the cut-away portion 60 of U-character along its shape, as shown in FIG. 3.

The diaphragm 51 has a support function by itself, because one end of the diaphragm 51 is a fixed end in communication with the baffle plate 50*a*. Therefore, the edge 70 does not need to bear the weight of the diaphragm 51, but only needs to have a function of keeping the airtightness. Accordingly, the edge can make an easily movable situation where the vibration of the diaphragm 51 is suppressed by using soft materials. In this embodiment, the edge 70 is a thin sheet member, and has a linear shape in the sectional direction of the cut-away portion 60, in which the journey of the line is larger than the sectional width of the cut-away portion 60. Thereby, the edge 70 can absorb the vibration width and keep the speaker enclosure airtight, irrespective of the vibration of the diaphragm 51.

Figure 2C:
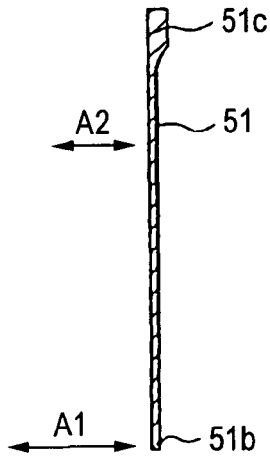

The sectional shape of the edge 70 is an arch, its diameter corresponding to the amplitude A1 at a lower end part 51*b* of the diaphragm 51. FIG. 2C is a view for explaining the vibration operation of the diaphragm 51. As shown in FIG. 2C, in the diaphragm 51, the amplitude of the vibration is increased with the greater distance from the connection portion 51*c*. That is, the amplitude A1 at the lower end part 51*b* of the diaphragm 51 and the amplitude A2 near the connection portion 51*c* are compared as A1>A2, as shown in FIG. 2C.

In this embodiment, since the edge 70 has a diameter corresponding to the maximum amplitude of the vibration portion 51*a* (amplitude A1 at the lower end part 51*b*), the edge 70 does not impede the vibration at any position of the diaphragm 51.

Figure 20:
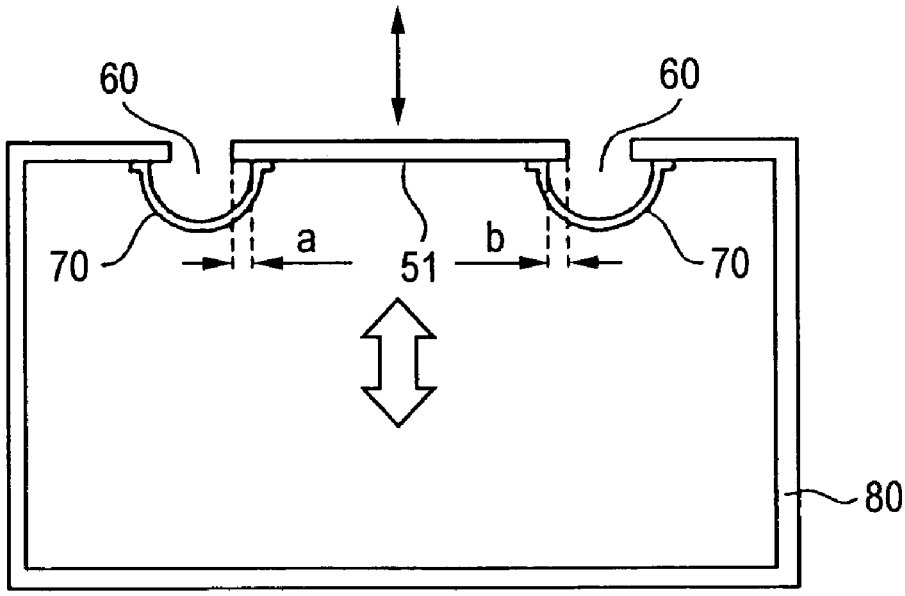
FIG. 20 is a view showing one example of the mounting position of edge.

Also, the edge 70 is attached so that its affixation portion 70*a* may be located near the outer margin of the diaphragm 51, as shown in FIG. 2B. This constitution will be described below by comparison with an example as shown in FIG. 20. FIG. 20 is a view showing an instance where the edge 70 is attached symmetrically around the center of the cut-away portion 60 not to impede the vibration of the diaphragm 51 In FIG. 20, a change in the air pressure occurring inside the speaker enclosure 80 is not directly transmitted to the end parts of the diaphragm 51 covered by the edge 70 (parts as indicated by a and b in FIG. 20).

On the contrary, in this embodiment, since a change in the internal pressure of the speaker enclosure 50 is directly transmitted over the entire diaphragm 51 without being impeded by the edge 70, an area of the diaphragm 51 subject to the change in the internal pressure of the speaker enclosure 50 can be widened, as shown in FIG. 2B. That is, the effective vibration area of the diaphragm 51 can be increased.

In the above constitution, if the loudspeaker 10 is driven, the vibration of a cone paper of the loudspeaker 10 is propagated to the air within the speaker enclosure 50, so that the vibration portion 51*a* of the diaphragm 51 is vibrated owing to the vibration of the air. At this time, the diaphragm 51 is vibrated in an airtight condition owing to the edge 70, and compresses or expands the air volume within the speaker enclosure 50 due to vibration. Accordingly, a new resonance frequency occurs owing to the compliance (mechanical flexibility) of an air spring of the speaker enclosure 50, in addition to bending elasticity of the diaphragm 51, and the equivalent mass of the diaphragm 51. As a result, the reproduction sound occurs around the resonance frequency of the diaphragm 51.

Herein, the bending elasticity (spring property) of the air spring and the diaphragm 51 acts such that two springs are equivalently connected in parallel, but since the air spring has a smaller compliance than the spring of the diaphragm 51, the resonance frequency of the diaphragm 51 as the loudspeaker system is roughly decided by the compliance of the air and the equivalent mass of the diaphragm 51.

The resonance frequency decided in the above way can be easily made a desired value in the bass area. For example, in the case where the internal capacity of the speaker enclosure 50 is 3.5 litters, employing the loudspeaker 10 with an effective diameter of 8 cm, the minimum resonance frequency of 70 z, and Q equal to 0.35, if the mass of the diaphragm 51 is 135 grams, the resonance frequency of the diaphragm can be 50 Hz.

Figure 4A:
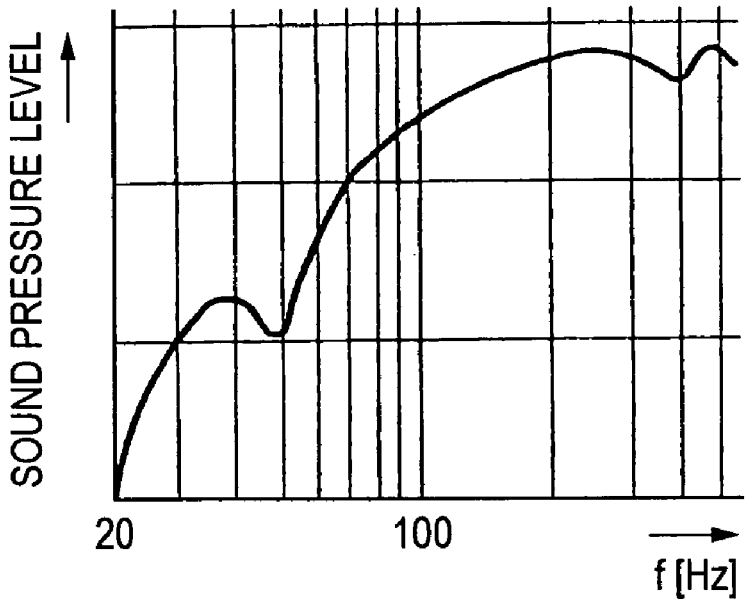
FIGS. 4A and 4B are graphs showing the frequency characteristic of the loudspeaker system according to the embodiment.
Figure 4B:
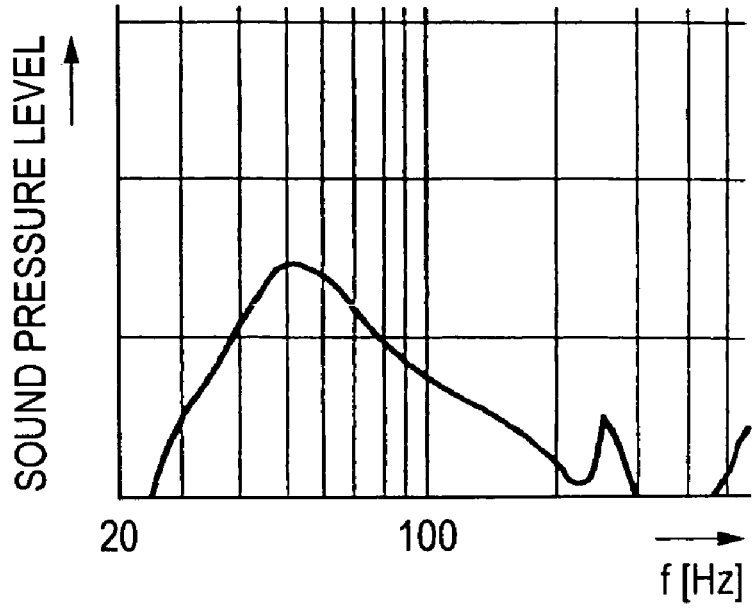

FIG. 4A is a graph showing the frequency characteristic of the loudspeaker 10 in the above specific example, and FIG. 4B is a graph showing the frequency characteristic of the diaphragm 51. As will be apparent from these graphs, when the above numerical values are set, the bass emphasized near 50 Hz can be outputted strongly in this embodiment. In this way, the action of a passive radiator such as the drone cone can be obtained by employing the flexural vibration of the diaphragm 51 in this embodiment.

Also, the vibration portion 51*a* reproduces the bass in a primary vibration mode where the entire portion vibrates flexibly such as a "round fan". Though the diaphragm 51 has the secondary, tertiary and higher order vibration modes, because the entire diaphragm 51 is driven by the air, the primary vibration mode occurs most strongly and the occurrence level in the other vibration modes is low. Also, if the higher order modes are intended to be further suppressed, the diaphragm 51 can be adjusted by selecting the material and the thickness or laminating the plural materials.

Also, the edge 70 in this embodiment can be made of softer material than the edge used in the conventional drone cone, and does not need to have the mechanical strength. In the passive radiator such as the conventional drone cone, the edge had two functions of supporting the diaphragm and securing the airtightness, because of the structure in which the diaphragm of rigid body is borne by the edge. However, in this embodiment, since the diaphragm 51 itself has the support function of the diaphragm 51, the edge 70 does not need to have the support function. Therefore, since it is necessary that the edge 70 can keep the airtightness within the speaker enclosure 50, it is possible to produce a situation where vibration of the diaphragm 51 is not impeded by using the softer material than before, and increase the vibration Q.

Also, the resonance frequency of the diaphragm 51 can be lowered by increasing the mass of the diaphragm 51. That is, it can be also adjusted by the size or material of the diaphragm 51, or easily adjusted by affixing some member to the diaphragm 51.

Figure 5:
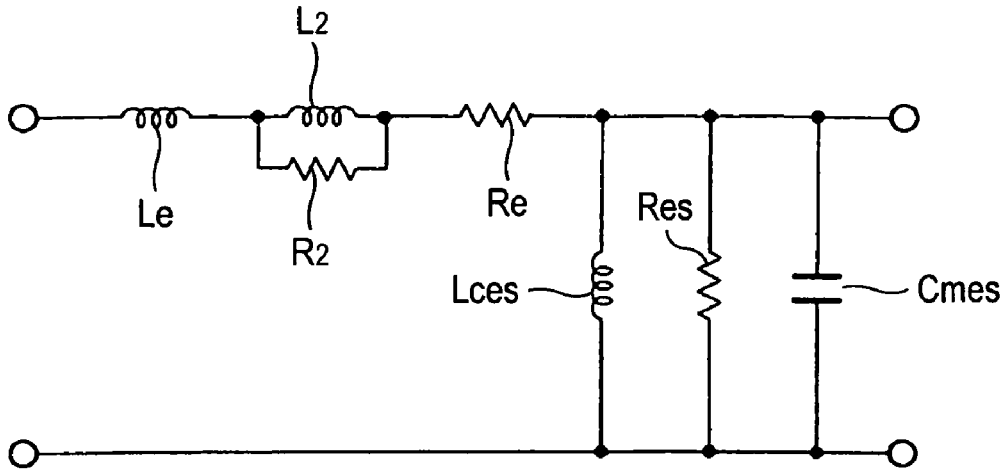
FIG. 5 is an electric equivalent circuit of the loudspeaker.

Herein, a difference between the invention and the related art will be described below, using an equivalent circuit. FIG. 5 is an electric equivalent circuit of the loudspeaker. A low frequency resonance circuit (resonance frequency=F0) composed of Cmes, Res and Lces via a voice coil impedance is driven by voltage.

Where

Re=DC resistance of voice coil

Le, L2, R2=High frequency impedance rising element

Cmes=Equivalent mass capacity of loudspeaker vibration system

Lces=Equivalent compliance inductance of loudspeaker vibration system

Res=Mechanical damping resistance of loudspeaker vibration system

Figure 6:
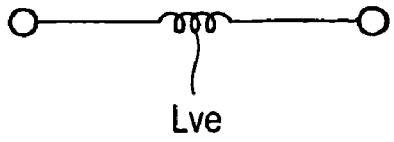
FIG. 6 is an electric equivalent circuit of a speaker enclosure.

FIG. 6 is an equivalent circuit of the speaker enclosure, where Lve is an equivalent volume inductance.

Figure 7:
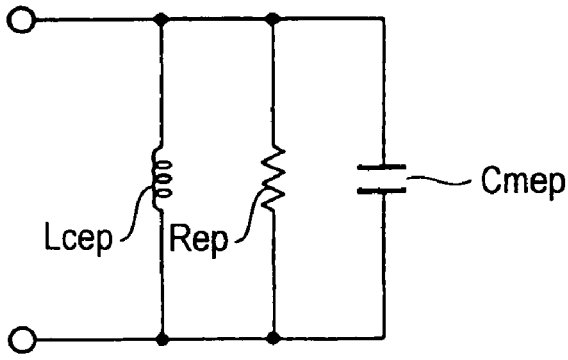
FIG. 7 is an equivalent circuit of the conventional passive radiator.

FIG. 7 is an equivalent circuit of the passive radiator such as the conventional drone cone or a hinge fixed flap. In a circuit configuration as shown in FIG. 7, a filter of the voice coil is removed from the loudspeaker. The mass Cmep is borne by the compliance Lcep and the damping resistance Rep for the edge.

Where

Cmep=Equivalent mass capacity of passive radiator

Lcep=Equivalent compliance inductance of passive radiator

Rep=Mechanical damping resistance of passive radiator

Figure 8:
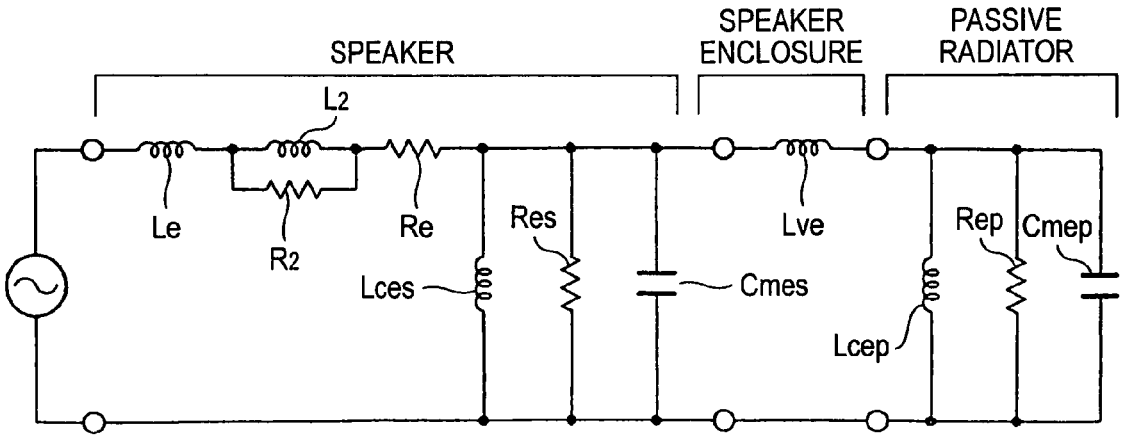
FIG. 8 is an equivalent circuit of the conventional passive radiator system.

FIG. 8 is an equivalent circuit of the conventional passive radiator. A signal voltage drives the loudspeaker and an acoustic output of the loudspeaker drives the passive radiator via a speaker enclosure volume.

The low frequency resonance frequency for the system is substantially the resonance frequency of Cmep and Lve. To decrease the resonance frequency with less volume, it is required that Cmep is increased, which means that the passive radiator is heavier. To bear the heavy passive radiator, the robust and strong edge is needed. On the other hand, the edge is required to have flexibility and is made of a soft material such as rubber or urethane, but is required to be thicker to increase the strength. However, to thicken the edge means that the equivalent compliance Lcep is decreased and at the same time the damping force is increased (the resistance value Rep is lower in the electric equivalent circuit). Therefore, the loss of the passive radiator is increased, and the reproduction ability of bass is degraded.

Figure 9:
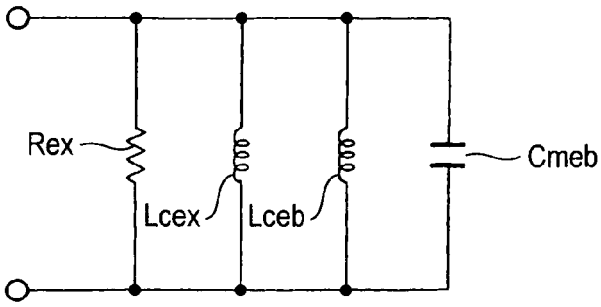
FIG. 9 is an equivalent circuit of a diaphragm according the invention.

FIG. 9 is an equivalent circuit of the diaphragm according to the invention. Since one side of the diaphragm is fully fixed, the diaphragm itself has the compliance Lceb and bears its dead weight. Since the diaphragm is made from the rigid body, the resistance component like the edge material can be ignored. Since the edge does not need to bear the dead weight of the diaphragm, the edge may be thin material to allow the compliance Lcex to be very large, whereby the loss is necessarily very small (the damping resistance Rex is increased in the electric equivalent circuit).

In FIG. 9,

Cmeb=Equivalent mass capacity of diaphragm

Lceb=Equivalent compliance inductance of diaphragm

Lcex=Equivalent compliance inductance of diaphragm edge

Rex=Mechanical damping resistance of diaphragm edge

Figure 10:
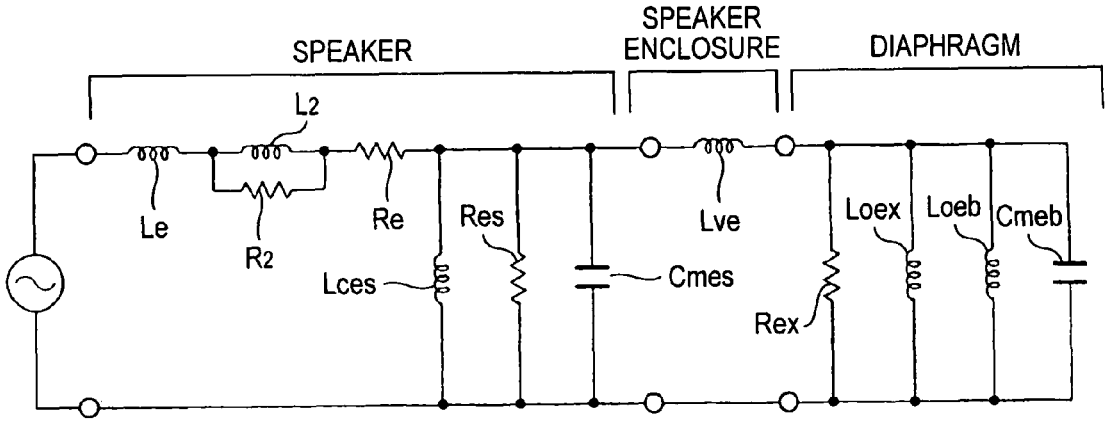
FIG. 10 is an equivalent circuit of the loudspeaker system according to the invention.

FIG. 10 is an equivalent circuit of the loudspeaker system according to the invention Supposing that the loudspeaker and the speaker enclosure volume are the same as in FIG. 8, if Cmep=Cmeb the resonance frequency at low frequency is also the same. Though the compliance bearing this weight is required to be equivalent, the compliance is Lcep in FIG. 8, and the compliance is substantially Lceb, because of Lcex>>Lceb, in FIG. 10. With the adequate design, Lcep is substantially equal to Lceb. The above factors have no great difference. However, as will be apparent from the above explanation, Rex>>Rep which is an important feature of this invention, whereby it can be found that the loss is significantly lower than the conventional method, with advantage for the bass reproduction.

Also, in this embodiment, the edge 70 is provided so that the affixation portion 70*a* may be located near the outer margin of the diaphragm 51, as described above. Therefore, a change in the internal pressure of the speaker enclosure 50 is directly transmitted over the entire diaphragm 51 without being impeded by the edge 70. That is, the effective vibration area of the diaphragm 51 can be increased.

Also, the edge 70 has the diameter corresponding to the amplitude A1 at the lower end part 51*b* of the diaphragm 51, and can vibrate the diaphragm 51 while absorbing its variations not to impede the vibration of the diaphragm 51.

Modified Embodiments

While the embodiment of the invention has been described above, the invention is not limited to the above embodiment, but various other forms may be made. In the following, the modified embodiments are presented.

Figure 11:
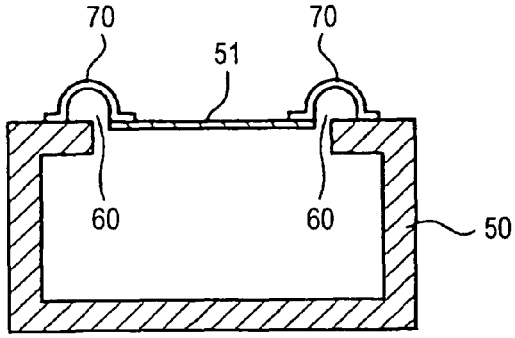
FIG. 11 is a view showing a modified embodiment of the invention.

(1) While in the above embodiment, the cut-away portion 60 is covered with the edge 70 from the inside of the speaker enclosure 50, the cut-away portion 60 may be covered from the surface side of the speaker enclosure 50, as shown in FIG. 11. FIG. 11 is a lateral cross-sectional view corresponding to FIG. 2B. By providing the edge affixation face outside in this way, the effective vibration area of the diaphragm 51 can be increased.

Also, by attaching the edge on the cut-away portion from the outside, the diaphragm can not be pulled outwards by inserting the finger into the cut-away portion, for example, thereby preventing the breakage of the speaker enclosure.

In this way, the edge (sealing member) may be provided on the surface side of one face (e.g., baffle face) of the speaker enclosure, or provided on the back side (internal space side).

Figure 12A:
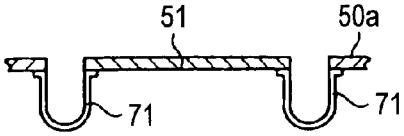
FIGS. 12A to 12H are views showing examples of the edge shape according to the modified embodiment of the invention.
Figure 12B:
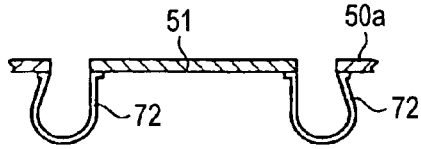
Figure 12C:
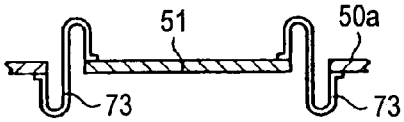
Figure 12D:
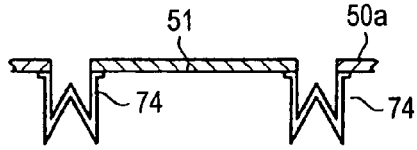

(2) The shape of the edge is not limited to the shape as shown in the above embodiment, but may be arbitrary shape as far as the diaphragm is vibrated corresponding to the maximum amplitude of the diaphragm, without exerting excess load on the diaphragm. For example, the edge may have the shapes as shown in FIGS. 12A to 12H. FIG. 12A shows an example in which a linear portion of sectional shape of the edge (a columnar portion of arch shape) according to the above embodiment is made longer, and FIG. 12B shows an example in which a curvilinear portion is made longer. Also, FIG. 12C shows an example using the edge of S-character type and FIG. 12D shows an example using the edge of M-character type. The edge is provided on the surface side or back side (internal space side) of one face of the speaker enclosure, like the S-character type of FIG. 12C, but may be attached to cross the cut-away portion from the surface side of the baffle face (one face) to the internal space side. In the example of FIG. 12D, the structure may have a difference in the height between mountain and valley of the M-character. Or the structure may have a multiplicity of mountains and valleys.

Figure 12E:
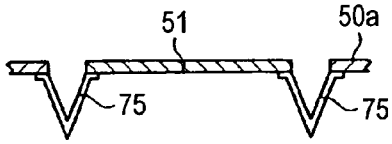
Figure 12F:
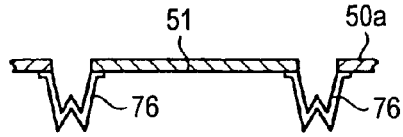
Figure 12G:
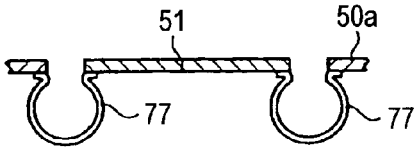
Figure 12H:
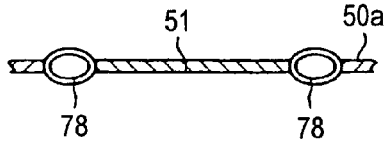

FIG. 12E shows an example in which the sectional shape of the edge is V-character type, FIG. 12F shows an example in which the sectional shape of the edge is W-character type, FIG. 12G shows an example in which the sectional shape of the edge is Ω-character type, and FIG. 12H shows an example in which the sectional shape of the edge is O-character type Of course, the edge may have a composite structure based on the shapes as shown in FIGS. 12A to 12H.

Figure 13A:
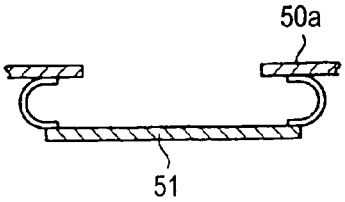
FIGS. 13A and 13B are views showing examples of the edge shape according to the modified embodiment of the invention.
Figure 13B:
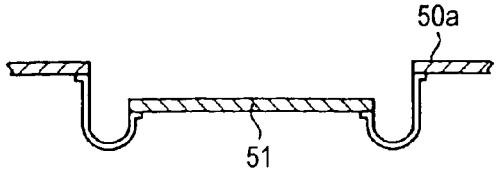

Also, in the above embodiment, the longitudinal position of the baffle plate 50*a* and the longitudinal position of the diaphragm 51 are coincident, but may be offset to the internal space on the bottom portion of the diaphragm 51, for example. In this way, in a part where the longitudinal position of the diaphragm 51 and the longitudinal position of its peripheral baffle plate 50*a* are different, the edge having the U-character type in section projecting to the internal space may be used, as shown in FIG. 13A. Or the edge having the J-character shape in section projecting to the internal space may be used, as shown in FIG. 13B. Besides, the edge may have various shapes of M-character type, V-character type and N-character type.

In the examples as shown in FIGS. 12 and 13, by setting the length of the journey in the linear shape of edge section to correspond to the maximum amplitude of the diaphragm, the diaphragm can be vibrated without exerting excess load on the diaphragm in the same way as in the above embodiment.

Further, since the edge is provided near the outer margin of the diaphragm, a change in the internal pressure of the speaker enclosure is directly transmitted to the diaphragm without being impeded by the edge, so that the effective vibration area of the diaphragm can be increased. Particularly in the example as shown in FIG. 13, the effective vibration area can be increased because the positional relation between the mounting plane and the diaphragm is different.

Figure 14A:
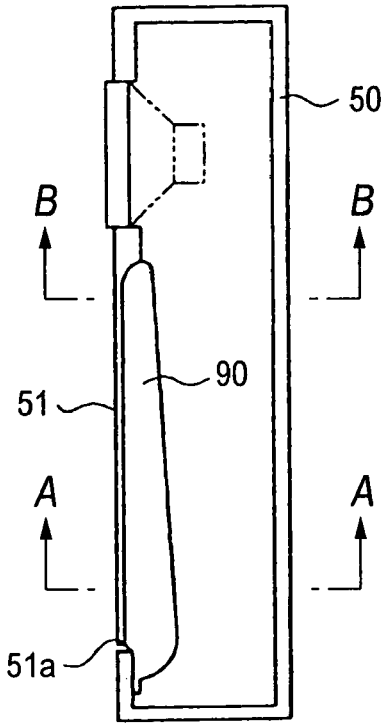
FIGS. 14A to 14D are views showing the modified embodiment of the invention.
Figure 14B:
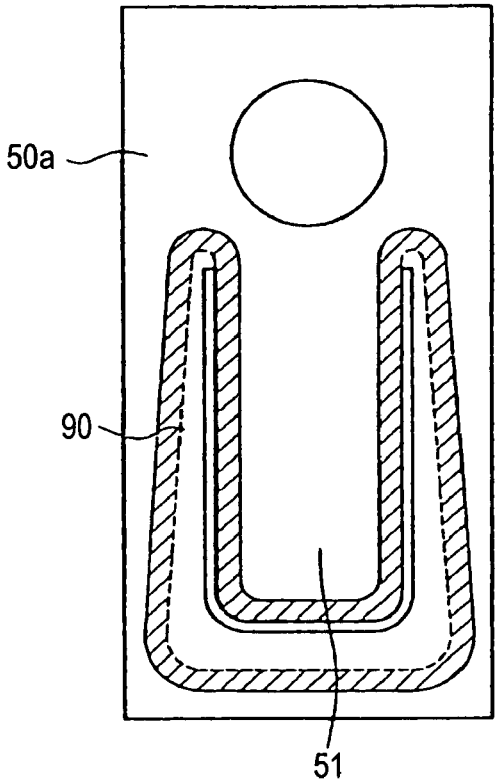
Figure 14C:
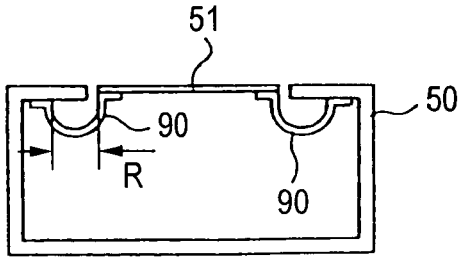
Figure 14D:
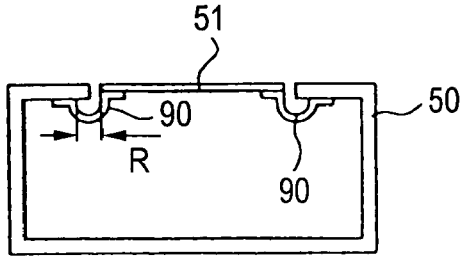
Figure 15A:
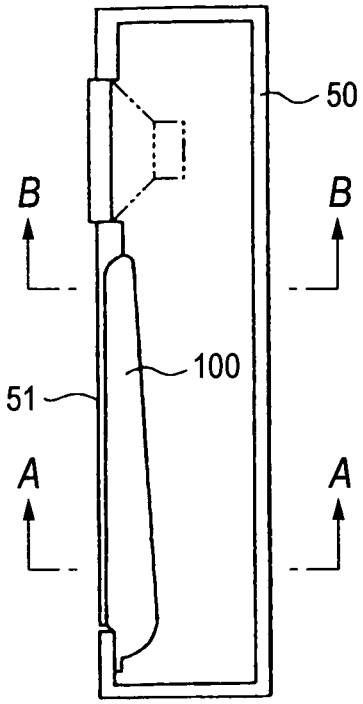
FIGS. 15A to 15D are views showing the modified embodiment of the invention.
Figure 15B:
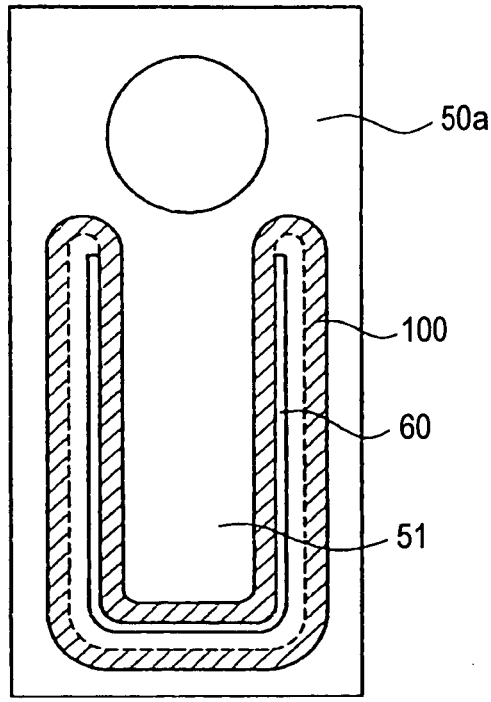
Figure 15C:
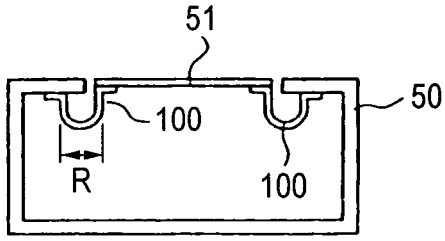
Figure 15D:
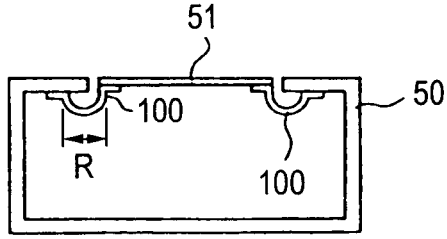

(3) In the above embodiment, the roll diameter of the edge 70 covering the cut-away portion 60 is uniform. Instead, the edge may have the shape in which the extended length is different with the location. Specifically, the edge 90 having the larger diameter of roll nearer the lower end part 51*b* of the diaphragm 51 may be provided, as shown in FIG. 14. FIG. 14A is a side cross-sectional view of the speaker enclosure in the modified embodiment. FIG. 14B is a view showing the rear face of the baffle plate 50*a* corresponding to FIG. 3. Also, FIGS. 14C and 14D are lateral cross-sectional views taken along the line A-A and the line B-B.

In the edge used for the conventional loudspeaker unit, a force applied on the edge has no displacement difference for each part. However, in the loudspeaker system having a partial difference in the displacement amount of the diaphragm as described in the above embodiment, the vibration of the diaphragm causes a distortion in the edge, and there is the possibility that the edge breaks down from the distorted part. Further, the effective vibration area of the diaphragm may be reduced to have the edge width in accordance with the maximum amplitude.

On the other hand, in the example as shown in FIG. 14, by gradually increasing the roll diameter R of the edge toward the lower portion, the amplitude of the diaphragm can be greater at the portion farther away from the support end of the diaphragm. Thereby, the diaphragm can be operated without exerting excess load on the diaphragm corresponding to the maximum amplitude, whereby the operation of the diaphragm can be smoothed. Also, there is no excess load or no distortion.

In the example as shown in FIG. 14, the edge having the greater diameter of the roll nearer the lower end part of the diaphragm is used. Instead, the edge 100 may have a longer straight portion of the edge nearer the lower end part of the diaphragm while the diameter R of the roll is fixed, as shown in FIG. 15.

Or by combining the examples of FIGS. 14 and 15, the edge may be used in which the diameter R of the roll and the length of the straight portion are increased with the greater distance from the support part of the diaphragm. Summarizing the above constitutions, the edge (sealing member) is preferably configured to be linear in the sectional shape, with the journey of the line changed according to the distance from the connection portion.

Figure 16:
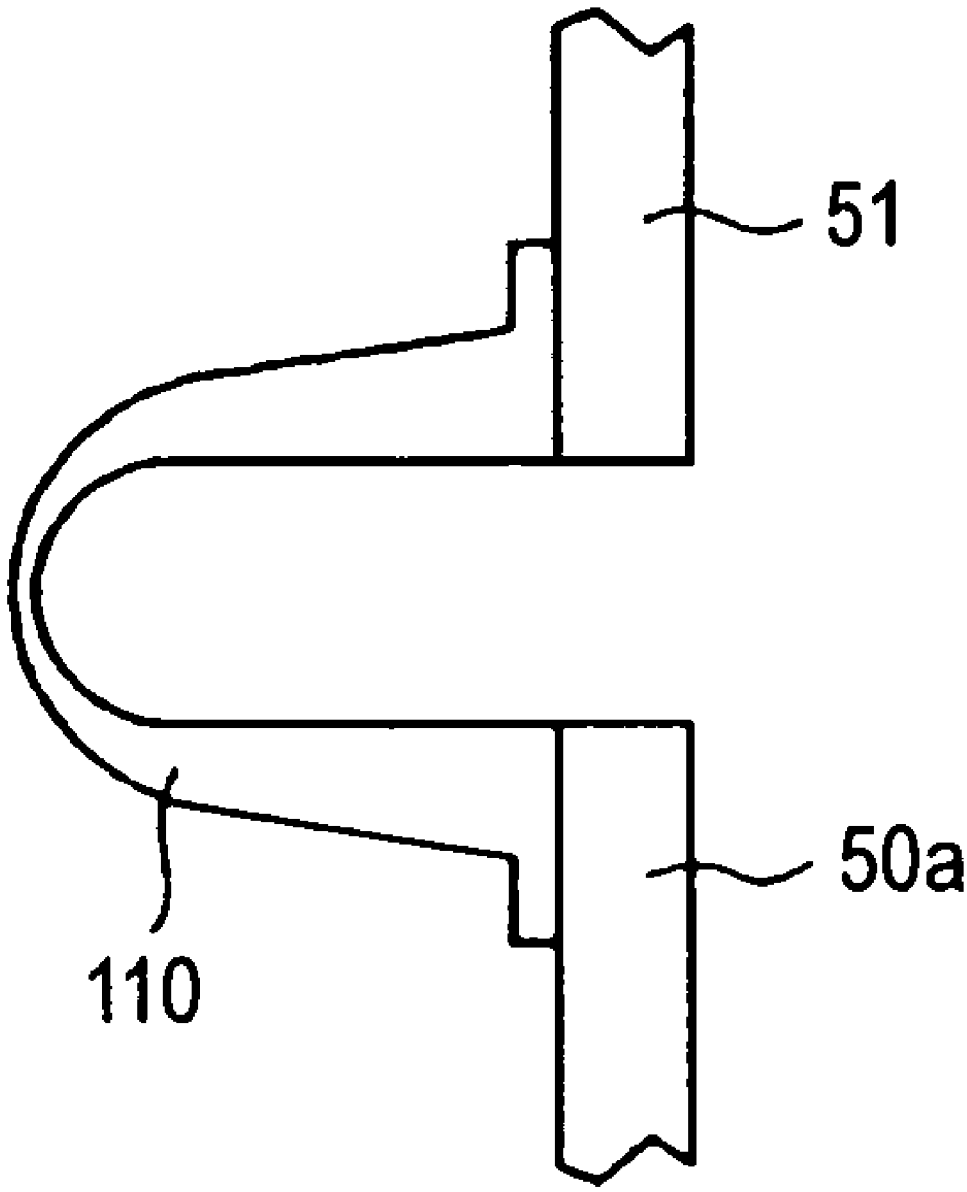
FIG. 16 is a view showing one example of the edge shape according to the modified embodiment of the invention.

(4) The edge may have its thickness different for each part. Specifically, the edge 110 in which its working portion is formed thin may be used, as shown in FIG. 16. In this way, the vibration operation of the diaphragm can be smoother.

That is, the edge (sealing member) may have a curved portion in its sectional shape, such that the thickness of the curved portion is thinner than the other portion. This constitution can be applied to the edges of all the types as described above.

(5) While in the above embodiment, the cut-away portion is provided on the face of the speaker enclosure where the loudspeaker is provided to form the diaphragm, the position where the diaphragm is formed (the cut-away portion is provided) is not limited thereto, but may be any position on one face of the speaker enclosure.

Figure 17A:
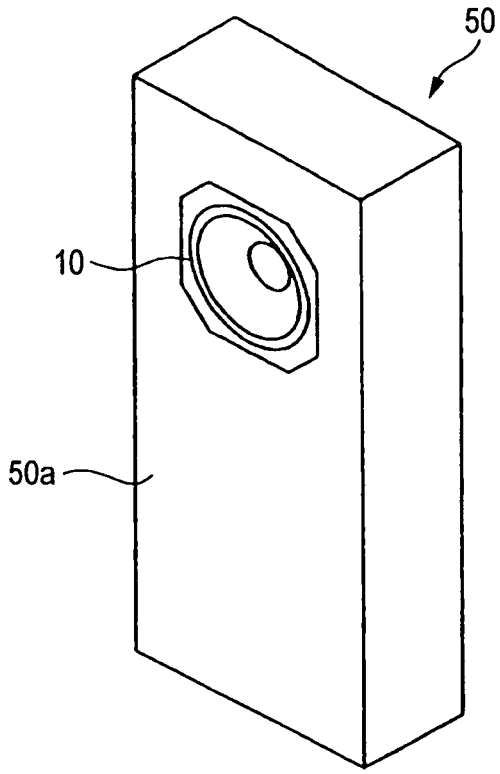
FIGS. 17A to 17C are views showing the modified embodiment of the invention.
Figure 17B:
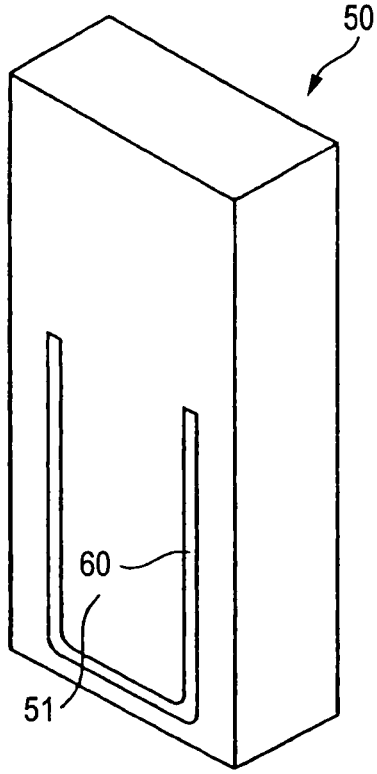
Figure 17C:
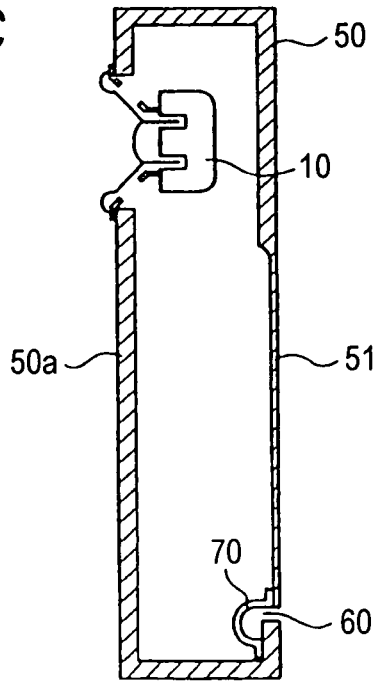

FIG. 17 is a view showing one example of the formation position of the diaphragm, in which FIG. 17A is a perspective view showing the appearance of the loudspeaker system, FIG. 17B is a perspective view of the modified embodiment as seen from the rear face, and FIG. 17C is a side cross-sectional view. As shown in FIGS. 17A to 17C, the cut-away portion 60 is provided on the face opposed to the baffle plate 50*a*, namely, on the rear face of the speaker enclosure 50 in this example.

Figure 18A:
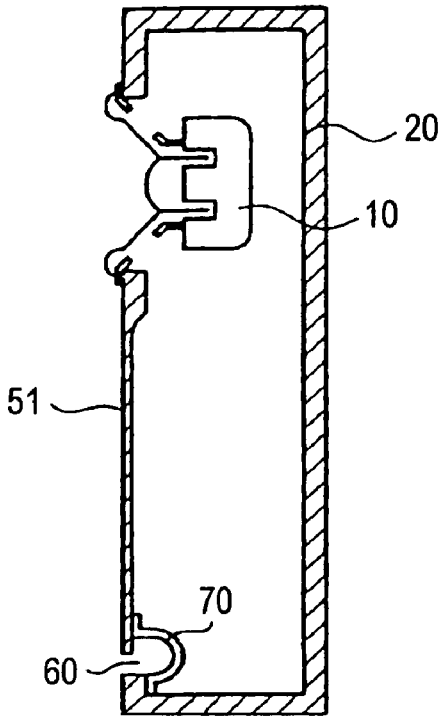
FIGS. 18A and 18B are views showing the modified embodiment of the invention.
Figure 18B:
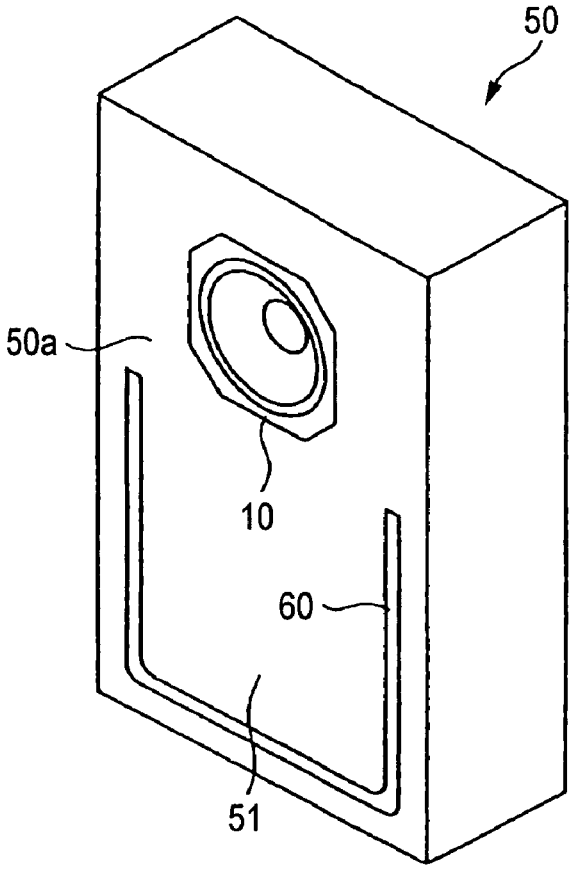

(6) In the case where the slender cut-away portion is made as in the above embodiment, the shape is not limited to the U-character. The shape may be V-character, trapezoid or O-character. In essence, supposing a virtual plane figure surrounded by the line on one face of the speaker enclosure, the cut-away portion may be cut away along the contour to have a part of the contour as the connection portion, and leave this connection portion behind, whereby the portion surrounded by the cut-away portion acts as the diaphragm that can vibrate due to bending elasticity as the point of support near the connection portion. For example, the appearance of the loudspeaker system is shown in FIG. 18B, but the cut-away portion 60 may be formed to constitute the entire lower portion of the baffle plate 50*a* as the diaphragm 51, as shown. FIG. 18A is a side cross-sectional view in this case.

Figure 19:
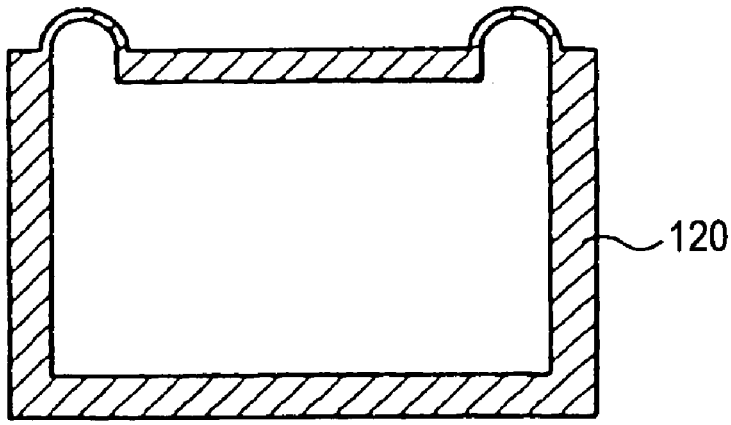
FIG. 19 is a view showing the modified embodiment of the invention.

(7) The speaker enclosure and the edge may be integrally formed, as shown in FIG. 19. Specifically, the edge portion may be formed thin and the wall face portion of the diaphragm and the speaker enclosure may be formed thick, using a member made of synthetic resin, for example. As an integral formation method, in a state where the rear face of the loudspeaker is excluded, the other five faces are integrally formed, and the rear face is thereafter bonded, for example.

(8) While in the above embodiment, the sectional shape of the edge is linear, and the journey of the line is larger than the sectional width of the cut-away portion to freely vibrate the diaphragm, the vibration of the diaphragm can be absorbed by expansion and contraction (bending elasticity), as far as the edge itself has flexible bending elasticity, even if the journey of the line in the sectional shape of the edge is the same as the sectional width of the cut-away portion.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2005-294481 filed on Oct. 7, 2005, the contents of which are incorporated herein for reference.

What is claimed is:

1. A loudspeaker system, comprising:

a speaker enclosure that includes a plurality of faces which surround so as to have an internal space tightly closed, at least one of the plurality of faces having a cut-away portion that is cut away along a contour of a virtual plane figure surrounded by a line on one face of the speaker enclosure while a part of the contour as a connection portion is left;

a sealing member that covers the cut-away portion so as to tightly seal the internal space of the speaker enclosure; and a loudspeaker that is provided on any face of the speaker enclosure, wherein a portion of the face surrounded by the cut-away portion is a diaphragm capable of vibrating due to bending elasticity while a near portion of the connection portion serves as a point of support; and wherein the sealing member is attached to the diaphragm and a peripheral portion which includes a portion of the one face surrounding the diaphragm so as to tightly seal the internal space of the speaker enclosure in a state that the diaphragm can vibrate.

2. The loudspeaker system according to claim 1, wherein the sealing member is a sheet-like member provided along the contour direction; and wherein a sectional shape of the sealing member is linear and a length of the line of the sectional shape is longer than a width of a cross-section of the cut-away portion, a direction of the width of the cross-section being perpendicular to an extending direction of the contour of the virtual plane figure.

3. The loudspeaker system according to claim 1, wherein the sealing member is attached from the diaphragm over the peripheral portion on a surface side or an internal space side of the one face.

4. The loudspeaker system according to claim 1, wherein the sealing member is attached from the diaphragm over the peripheral portion so as to cross the cut-away portion from a surface side of the one face to an internal space side of the one face.

5. The loudspeaker system according to claim 2, wherein the sealing member has a linear sectional shape; and wherein the length of the line is varied in accordance with a distance from the connection portion.

6. The loudspeaker system according to claim 1, wherein the sealing member has a curved portion in a sectional shape of the sealing member; and wherein a thickness of the curved portion is smaller than the other sectional portion of the sealing member.

7. The loudspeaker system according to claim 1, wherein the sealing member is integrally formed with at least the one face.

8. The loudspeaker system according to claim 1, wherein both end parts of the sealing member in a sectional direction are fixed to the diaphragm and the peripheral portion; and wherein an end part fixed to the diaphragm is proximate to an edge of the diaphragm.

* * * * *